United States Patent [19]

Shiozaki et al.

[11] 4,365,496

[45] Dec. 28, 1982

[54] ROLLING PROCESS

[75] Inventors: Hiroyuki Shiozaki, Yokosuka; Masao Mikami, Fujisawa; Isao Imai; Toshio Iwanami, both of Yokohama, all of Japan

[73] Assignee: Ishikawajima-Harima Jukogyo Kabushiki Kaisha, Tokyo, Japan

[21] Appl. No.: 880,931

[22] Filed: Feb. 24, 1978

[30] Foreign Application Priority Data

Mar. 1, 1977 [JP] Japan ..... 52-22033

[51] Int. Cl.[3] ..... B21B 35/00

[52] U.S. Cl. ..... 72/249; 72/8; 72/17; 72/366

[58] Field of Search ..... 72/199, 205, 366, 249, 72/8, 17, 19

[56] References Cited

U.S. PATENT DOCUMENTS 2,178,674 11/1939 Simons ..... 72/205

3,811,307 5/1974 Vydrin et al. ..... 72/205

*Primary Examiner*—Francis S. Husar

*Assistant Examiner*—Jonathan L. Scherer

*Attorney, Agent, or Firm*—Scrivener, Clarke, Scrivener and Johnson

[57] ABSTRACT

A rolling process wherein a pair of working rolls are driven at different peripheral velocities so that the peripheral velocity ratio may be varied, and the peripheral velocity ratio is so controlled that the rolling torque of each of the working rolls may be within a maximum tolerable torque which the working roll may transmit, thereby reducing the rolling force.

1 Claim, 13 Drawing Figures

ROLLING PROCESS

DETAILED DESCRIPTION OF THE INVENTION

The present invention relates to a rolling process for a sheet metal.

In general, the percent reduction in thickness or the rolling reduction is limited by a torque transmitted from a rolling stand, in the case of a thicker metal sheet, or limited by a rolling force with which is controlled the shape of metal sheet, in the case of a thinner metal sheet.

The present invention provides a rolling process wherein the rolling torques of a pair of working rolls may be limited within a transmitable range and wherein the peripheral velocity ratio between the pair of working rolls is so varied as to reduce the rolling force.

In the prior process of rolling a sheet metal, a piece of metal c is made to pass between a pair of working rolls a and b having a same diameter as shown in FIG. 1. The pair of work rolls a and b are rotated at the same peripheral velocity so that the neutral lines or points C are on the same vertical line. As a result, the frictional forces are exerted in the directions indicated by the arrows to the metal c in the bite zone (hatched area) so that the metal c is subjected to horizontal compression forces and consequently an extremely great rolling force is produced between the working rolls a and b. In view of the strength of the rolling mill and in order to decrease the elastic deformation of the rolling mill to maintain the desired flatness of the rolled sheet metal, the rolling force must be reduced as practically as possible.

To this end, there has been proposed to use a pair of working rolls having a small diameter because the rolling force is nearly in proportion to the root of the diameter of the working rolls. For instance, a four-high rolling mill shown in FIG. 2 is based upon this principle. The pair of working rolls a and b have a relatively small diameter while large-diameter backing rolls d and e receive the extremely high rolling force. Thus the four-high roll stand is improved both in strength and rigidity. However the diameter of the working rolls is limited because of deflections of the working rolls and because a rolling torque exerted to the metal from the small-diameter working rolls is limited.

In order to overcome these problems, a cluster mill stand has been used. The diameter of the working rolls a and b is by far smaller than the diameter of the working rolls of the four-high mill stand so that the rolling force may be reduced. However the cluster mill stand is disadvantageous over the four-high rolling stand in that because of the small diameter the thermal capacity of the working rolls is less so that the working rolls are adversely affected by heat and that the increase in number of rolls results in the increase in cost. Therefore the cluster rolling stands have been used only for rolling high-tensile steel plates or sheets such as stainless or silicon steel sheets.

Therefore there has been a strong demand for a rolling mill which has the advantages of not only the four-high mill stands but also the cluster rolling stands. This demand may be satisfied by the recently developed RD process (rolling drawing process) wherein a pair of working rolls are rotated at different peripheral velocities. The RD process is advantageous particularly when a thin sheet metal is rolled because the rolling force may be considerably reduced.

Referring to FIG. 4 the underlying principle of the RD process will be described. In this process it is essential to maintain the following relation:

$$V_1/V_o = h_o/h_1 = \lambda$$

where $V_o$=the peripheral velocity of an upper (or a low-speed) work roll a, $V_1$=the peripheral velocity of a lower (or a high-speed) working roll b, $h_o$=the thickness of the metal entering the rolls, $h_1$=the thickness of the metal leaving the rolls, and $\lambda$=the elongation ratio.

Furthermore the following conditions must be satisfied:

$v_o = V_o$ and $v_1 = V_1$ where $v_o$=the velocity of the metal entering the rolls, and $v_1$=the velocity of the metal leaving the rolls.

Then the neutral point on the side of the upper working roll a coincides with the entrance point A while the neutral point on the side of the lower working roll b, with the leaving or exit point B.

FIG. 5 shows the equilibrium among various forces at a cross section of the metal piece under these conditions. It is seen that the horizontal frictional force ($\mu pr\, dx/\cos\theta$) cancel each other so that the so-called friction hill may be eliminated and consequently the rolling force is reduced to a few fractions as compared with the prior art rolling mills. For instance, the reduction in rolling force to $\frac{1}{3}$ is equivalent to the reduction in roll diameter to 1/9.

Referring to FIG. 8, with the rolling mill of the type wherein the pair of working rolls are rotated at the same peripheral velocity as shown in FIG. 1, the neutral point is at C and the the so-called friction hill A'C'B' with the peak C' is formed. The rolling force is expressed in terms of the area OA'C'B'O' which is very large. With the RD process, the neutral points are at A and B (the entrance and exit points), and the rolling force is measured in terms of the area OA'B'O' which is considerably smaller than the area OA'C'B'O'. Even though the RD process may considerably reduce the rolling force as compared with the prior art rolling processes as described above, it still has some disadvantages to be described below.

(1) It is rather difficult to keep the neutral points coincident with the entrance and exit points A and B as shown in FIG. 4. In general, the neutral point is dependent upon various factors such as the thickness of the metal piece to be rolled, the resistance to deformations of the metal piece, tensions forwardly and backwardly exerted to the metal piece and the friction between the surfaces of the working rolls and the metal piece. And there have been proposed various methods for keeping the neutral points coincident with the entrance and exit points. One example is shown in FIG. 6 wherein a metal piece is partly wrapped around both the upper and lower working rolls a and b so that the frictional forces between the surfaces of the working rolls a, b and the metal piece may be utilized to attain the conditions $v_o = V_o$ and $v_1 = V_1$.

However, with the four-high rolling mill shown in FIG. 2 it is difficult to wrap the metal piece around not only the working rolls but also backup rolls. Furthermore this process is disadvantageous in that the smooth supply of lubricant to the contact surfaces between the working rolls and the metal piece may be difficult, slip marks may be produced due to the slippage between the working rolls and the metal piece and the passing of the metal piece through the rolling stands may be difficult.

(2) The rolling torques exerted to the working rolls are considerably increased as compared with the conventional rolling processes so that the rolling torques beyond a certain limit cannot be transmitted because of the limited rigidity of the rolling mill. Referring to FIG. 7, the rolling torque is defined as the product of the force tangent to the surface of the working roll and the radius R of the working roll. With the two-high rolling mill shown in FIG. 1, tangential forces on either side of the no-slip line C are opposite in direction as shown in FIG. 7(A). But, in the RD process, as shown in FIG. 7(B) the direction of tangential forces on the surface of the fast working roll are opposite to the direction of rotation of the working roll while tangential forces on the surface of the slow working roll are in the same direction with the direction of rotation of the roll. As a result, the rolling torques exerting on each roll are three to five times as high as the rolling torques exerting on the working rolls of the two-high rolling stand. Since the roll driving system has no strength sufficient to withstand such high rolling torques, the working rolls must be increased in diameter so that the rolling force cannot be reduced.

In view of the above, one of the objects of the present invention is to provide a rolling process which may substantially eliminate the above and other problems encountered in the conventional RD process so that the rolling force may be reduced and the rolling efficiency may be improved.

Another object of the present invention is to provide a rolling process which may ensures very stable rolling torque transmission.

The present invention will become apparent from the following description of preferred embodiments thereof taken in conjunction with the accompanying drawings, in which.

Figure 7A:
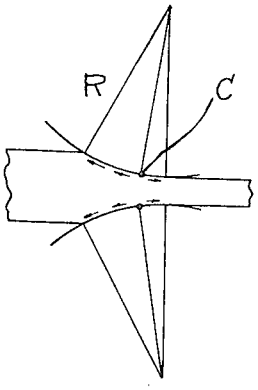
PRIOR ART FIG.7A
Figure 7B:
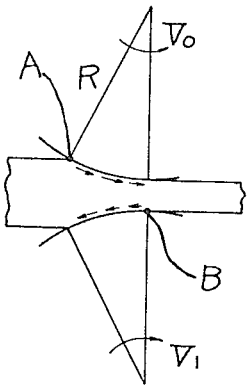
PRIOR ART FIG.7B
Figure 8:
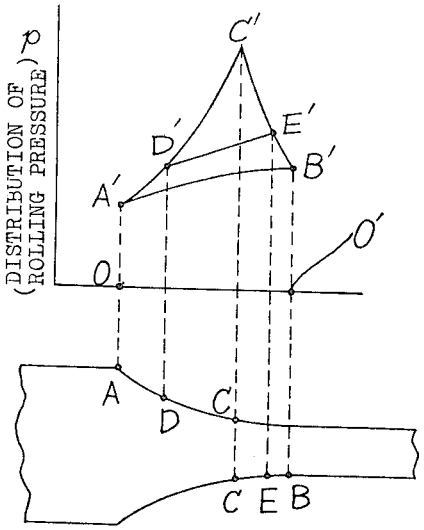
Figure 9:
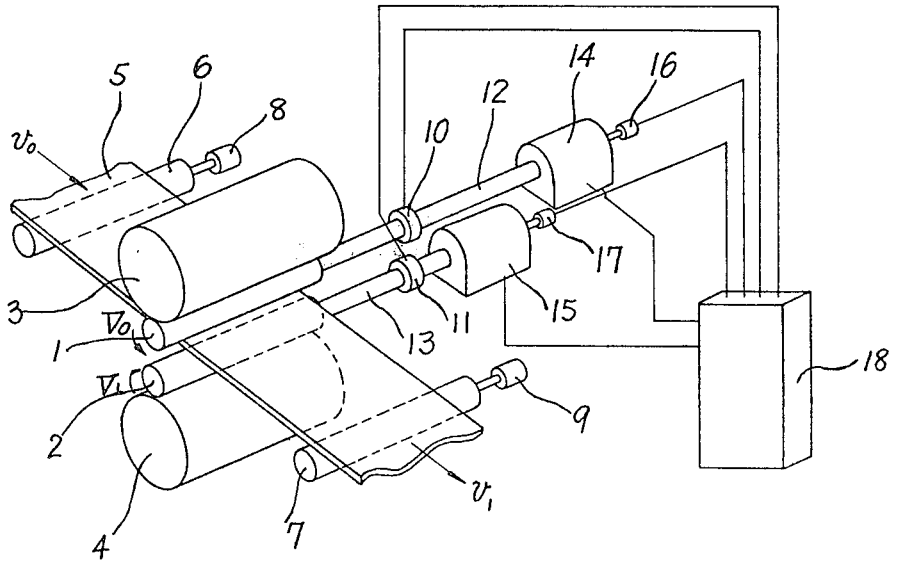
Figure 10A:
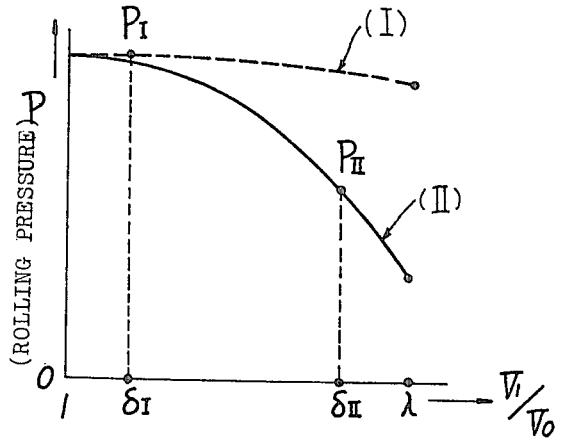
Figure 10B:
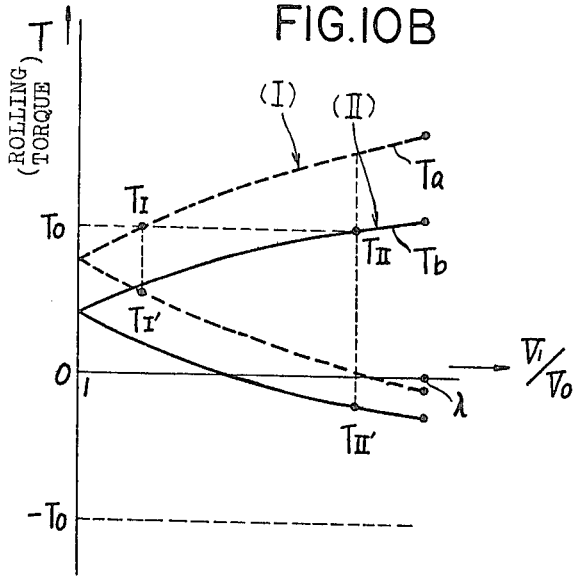

FIGS. 7(A) and 7(B) are views used for the explanation of the tangential forces acting on the surfaces of the working rolls which are rotated at the same peripheral velocity in FIG. 7(A) and which are rotated at a predetermined peripheral velocity ratio according to the RD process in FIG. 7(B);

FIG. 8 is a view used for the explanation of the distribution of the rolling pressure in a metal piece being rolled;

FIG. 9 is a schematic perspective view of a first embodiment of the present invention;

FIG. 10(A) is a graph showing the relationship between the ratio in peripheral velocity between a pair of working rolls and the rolling force;

FIG. 10(B) is a graph showing the relationship between the ratio in peripheral velocity between a pair of working rolls and the rolling torque.

Figure 11:
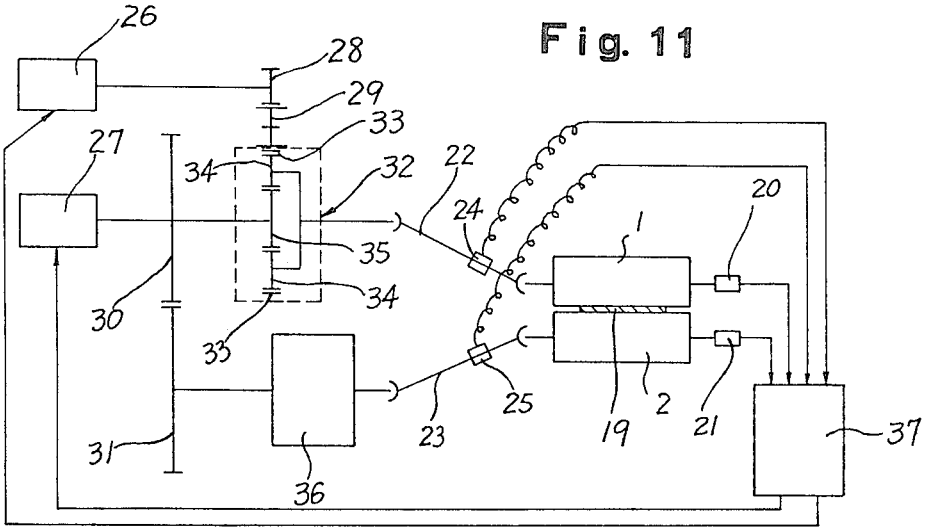
Figure 12:
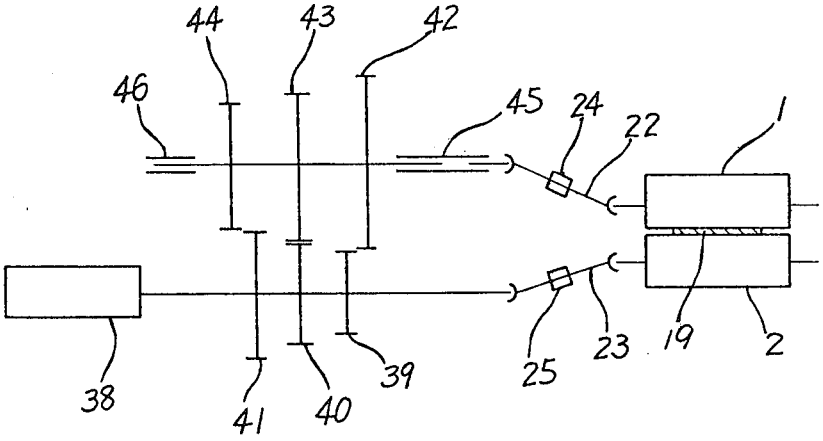
Figure 13:
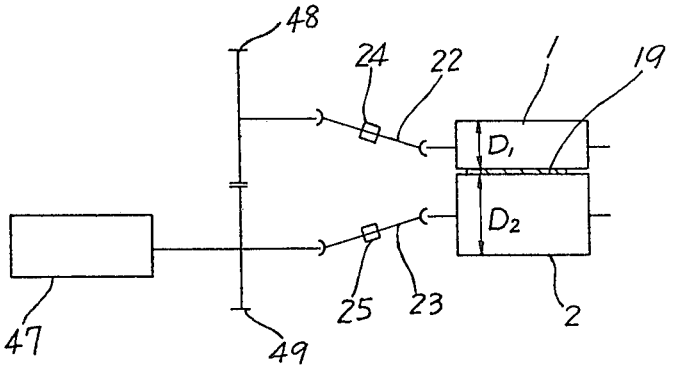

FIG. 11 is a schematic view of a second embodiment of the present invention;

FIG. 12 is a schematic diagram of a third embodiment of the present invention; and FIG. 13 is a schematic diagram of a fourth embodiment of the present invention.

Referring to FIG. 9, the first embodiment of the present invention will be described.

A rolling mill shown in FIG. 9 includes a pair of upper and lower working rolls 1 and 2 backed up by upper and lower backing rolls 3 and 4, respectively. An entering velocity monitor 6 detects the entering velocity of a metal piece 5 while a leaving velocity monitor 7 detects the velocity of the metal piece 5 leaving the working rolls 1 and 2. Tachometers 8 and 9 are connected to the velocity monitors 6 and 7, respectively. Torque meters 10 and 11 are mounted on spindles 12 and 13, respectively, of the upper and lower working rolls 1 and 2. Motors 14 and 15 are connected to the spindles 12 and 13, respectively, for driving the upper and lower working rolls 1 and 2. Tachometers 16 and 17 are mounted on the drive shafts of the motors 14 and 15 and are operatively coupled to an automatic control unit 18 which is responsive to the electrical output signals from the torque meters 10 and 11 and the tachometers 16 and 17 for generating the control signals for controlling the rotational speeds of the motors 14 and 15 so that the upper and lower working rolls 1 and 2 may be rotated at a desired peripheral velocity ratio. The automatic control unit 18 is also so constructed and arranged as to display various data.

The thickness $h_o$ of the metal piece 5 entering the working rolls 1 and 2, the thickness $h_1$ of the metal piece leaving them and the maximum torque which the working rolls 1 and 2 can transmit to the metal piece 5 are all given. In rolling, therefore, the rolling torque is maintained less than the maximum torque while the ratio in peripheral velocity $V_1/V_o$ between the upper and lower working rolls 1 and 2 ($V_1$=the peripheral velocity of the lower working roll 2 and $V_o$=the peripheral velocity of the upper working roll 1) is maintained as high as possible within $h_o/h_1$ where $h_o$=the thickness of the metal piece 5 entering the working rolls and $h_1$=the thickness of the metal piece 5 leaving the rolls.

To these ends, the speed ratio between the motors 14 and 15 is preset to a ratio less than $h_o/h_1$, thereby presetting the peripheral velocity ratio $V_1/V_o$.

During the rolling operation, the peripheral velocities $V_o$ and $V_1$ of the upper and lower working rolls 1 and 2 are detected in terms of the rotational speeds of the motors 14 and 15 by the tachometers 16 and 17, and in response to the output signals from these tachometers 16 and 17 the automatic control unit 18 controls the motors 14 and 15 so that the deviation from the predetermined peripheral velocity ratio $V_1/V_o$ may be automatically corrected. The rolling torques are detected by the torque meters 10 and 11, and in response to the outputs from the meters 10 and 11 the automatic control unit 18 controls the motors 14 and 15 in such a way that when the torques are less than the maximum or tolerable value, the peripheral velocity ratio $V_1/V_o$ may approach to the thickness ratio $h_o/h_1$. That is, in order to maintain the rolling torques as high as possible within the maximum tolerable level, the peripheral velocity ratio between the upper and lower working rolls is maintained as high as possible under the condition that $V_1/V_o < h_o/h_1$. The peripheral velocity ratio control may be effected not only by the automatic control unit 18 but also by the manual operations.

The entering velocity $v_o$ measured by the velocity monitor 6 and the leaving velocity $v_1$ measured by the velocity monitor 7 must satisfy the conditions $v_o/V_o < 1$ and $v_1/V_1 > 1$. The velocity monitors 6 and 7 and the tachometers 8 and 9 are very effective means for ensuring the stable rolling operation, but they do not constitute the essential elements of the present invention. And under the above conditions the peripheral velocity ratio $V_1/V_o$ is maintained as high as possible within the range of $1 \leqq V_1/V_o < h_o/h_1$.

Figure 1:
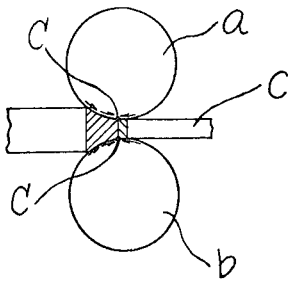
PRIOR ART Fig. 1
FIG. 1 is a schematic side view of a two-high rolling mill wherein a pair of working rolls are rotated at the same peripheral velocity.
Figure 2:
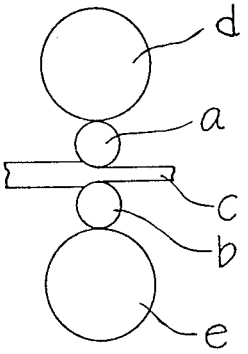
PRIOR ART Fig. 2
FIG. 2 is a schematic side view of a four-high rolling mill.
Figure 3:
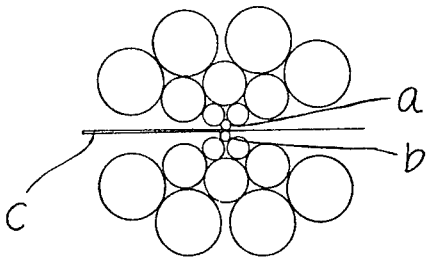
PRIOR ART Fig. 3
FIG. 3 is a schematic side view of a cluster rolling mill.
Figure 4:
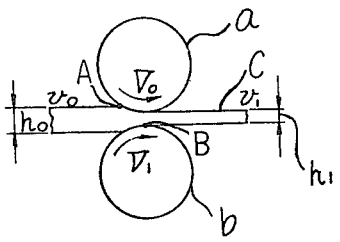
PRIOR ART Fig. 4
FIG. 4 is a schematic view of a rolling mill having a low-speed upper roll and a high-speed lower roll.
Figure 5:
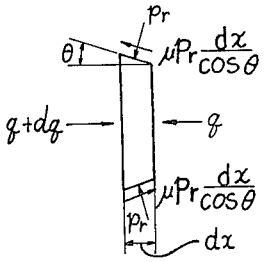
PRIOR ART Fig. 5
FIG. 5 is a view used for the explanation of the equilibrium among forces in the RD process.

As described above according to the present invention, under the conditions that the ratio in thickness between the entering and leaving metal piece, the tensions exerted to the entering and leaving metal piece and the resistance to deformations of the metal piece are maintained constant and that the rolling torques are less than the maximum tolerable level, the peripheral velocity ratio $V_1/V_o$ is controlled so that the neutral point on the side of the fast roll (the lower working roll 2) may be located at a point E between the points C and B (See FIG. 8) while the neutral point on the side of the slow roll (the upper working roll 1) may be located at D between the points A and C, whereby the metal piece may be rolled under the rolling force which is equal to the area OA'D'E'B'O' in FIG. 8. Since the area OA'D'E'B'O' is by far smaller than the area OA'C'B'O' representing the rolling force in case of the two-high rolling stand shown in FIG. 1, it is apparent that the rolling force may be considerably reduced.

Figure 6:
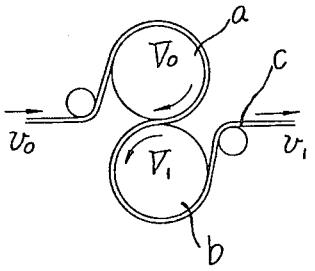
PRIOR ART Fig. 6
FIG. 6 is a schematic side view of a RD mill wherein a metal piece is partially wrapped around a pair of working rolls so that the neutral points may coincide with the entrance and exit points.

The neutral point D may be between the points A and C while the neutral point E, between the points C and B in FIG. 8. Since the neutral points D and E are not fixed, the stable rolling operation may be ensured. With the two-high rolling mill shown in FIG. 1, the neutral points C tend to move to dynamically equilibrium points as the external disturbances in rolling such as the variations in thickness of a metal piece, resistance to deformations, tensions exerted to the entering and leaving metal piece, frictional coefficient between the working rolls and the metal piece occur. In the RD process, in order to keep the neutral points coincident with the entrance and exit points as shown in FIG. 7(B), the predetermined difference between the tensions exerted on the entering and leaving metal piece must be maintained. In order to keep the neutral points coincident with the entrance and exit points stably, the metal piece is often partially wrapped around the working rolls as shown in FIG. 6. However according to the present invention when external disturbances occur, the neutral points D and E move to the points where the dynamic equilibrium may be maintained. As a consequence, no limit is imposed on the entering and leaving velocities of the metal piece so that the rolling operation may be much facilitated.

Referring to FIG. 10(A), the rolling force p is plotted along the ordinate while the peripheral velocity ratio $V_1/V_o$ is plotted along the abscissa. In FIG. 10(B), the rolling torque T is plotted along the ordinate while the peripheral velocity ratio $V_1/V_o$ along the abscissa. According to the RD process, the metal piece is rolled at a predetermined peripheral velocity ratio $\lambda = h_o/h_1 = V_1/V_o$.

Referring back to FIG. 8, the thinner the metal piece, the greater the frictional coefficient between the working rolls and the metal piece and the longer the arc of contact between the working roll and the metal piece, the greater the area of the friction hill A'C'B' becomes. In other words, the area of the friction hill varies considerably depending upon the rolling conditions.

Referring back to FIG. 10, the pass schedule I is used when the metal piece has a relatively greater thickness, the friction hill is small and the rolling torque is high. When the thickness is thin, the friction hill is large and the rolling torque is small, the pass schedule II is used.

Assume that in the RD process, the maximum transmission torque of each of the working rolls be $T_o$. Then the torque $T_a$ and $T_b$ of the fast working roll both in the case of the pass schedule I and in the case of the pass schedule II exceed $T_o$ so that no rolling can be made. However, according to the present invention, the peripheral velocity ratio $V_1/V_o$ between the pair of working rolls 1 and 2 is so selected that the rolling torque may be maintained within the maximum tolerable torque $T_o$. Therefore with the pass schedule I, the rolling torques are $T_I$ and $T_{I'}$ while with the pass schedule II they are $T_{II}$ and $T_{II'}$. The rolling forces are $P_I$ and $P_{II}$, respectively. Therefore it is apparent that the pass schedule II attains remarkable results while the pass schedule I attains less reduction in rolling force.

Referring to FIG. 11, the second embodiment of the present invention will be described.

A metal piece 19 is rolled by a pair of upper and lower working rolls 1 and 2 whose peripheral velocities are detected by tachometers 20 and 21, respectively. The drive shafts of motors 26 and 27 carry gears 28 and 30, respectively, which in turn are in constant mesh with gears 29 and 31, respectively. A planetary gear set generally indicated by the reference numeral 32 consists of externally and internally threaded ring gears 33, planetary gears 34 and a sun gear 35 carried coaxially of the gear 30. The gear 29 is in mesh with the externally threaded teeth of the ring gear 33 while the internally threaded teeth of the ring gear 33 is in mesh with the planetary gears 34 which in turn are in mesh with the sun gear 35. The gear 31 is connected through a reduction gear 36 to a spindle 23 of the lower working roll. A torque meter 25 is attached to the spindle 23. The planetary gears 34 are connected to a spindle 22 of the upper working roll 1. A torque meter 24 is attached to the spindle 22. An automatic control unit 37 which is electrically connected to the tachometers 20 and 21, the torque meters 24 and 25 and the motors 26 and 27 displays various data such as the rolling torques and controls the motors 26 and 27 in response to the outputs from the tachometers 20 and 21 and from the torque meters 24 and 25 so that a predetermined peripheral velocity ratio $V_1/V_o$ may be maintained.

The mode of operation of the second embodiment is substantially similar to that of the first embodiment. That is, the ratio in rotational speed between the motors 26 and 27 is preset less than the elongation ratio $h_o/h_1$. In response to the outputs from the torque meters 24 and 25, the automatic control unit 37 controls the motors 26 and 27 in such a way that the peripheral velocity ratio $V_1/V_o$ may be maintained as high as possible under the conditions described elsewhere.

In the third embodiment as shown in FIG. 12, instead of the planetary gear set 32, a transmission unit which is simple in construction as compared with the planetary gear sets is used to change the peripheral velocity ratio $V_1/V_o$. That is, one of three gears 42,43 and 44 which are slidden by gear shifting means 45 and 46 is brought in mesh with one of gears 39, 40 and 41 carried by the drive shaft of a motor 38.

The third embodiment is advantageous in that only one motor 38 is used for driving both the upper and lower working rolls 1 and 2 with different peripheral velocities and that the manually selective gear transmission unit is employed for changing the peripheral velocity ratio $V_1/V_o$ between the upper and lower working rolls 1 and 2 so that the tachometers and the automatic control unit may be eliminated.

The fourth embodiment as shown in FIG. 13 is simplest in construction. The upper and lower working rolls 1 and 2 have different diameters $D_1$ and $D_2$, respectively, and the condition is $D_1 < D_2$. The diameter ratio $D_2/D_1$ is charged depending upon the peripheral velocity ratio $V_1/V_o$. A common motor 47 drives the respective rolls 1 and 2 at a same revolutional speed through gears 48 and 49 having a same number of teeth and spindles 22 and 23.

In this embodiment, the upper and lower working rolls 1 and 2 having different diameters are given at a same revolutional speed through gears 48 and 49 having a same number of teeth so that the peripheral velocity ratio $V_1/V_o$ may be selected depending upon the difference in diameter between the upper and lower working rolls 1 and 2. Of course, torque meters 24 and 25 are indispensable also in this case.

In summary, according to the present invention the peripheral velocity ratio between the upper and lower working rolls is so controlled that the rolling torque may be maintained as high as possible within the maximum tolerable rolling torque and the neutral points may be located between the neutral points attained with the conventional process with rolls having a same diameter and a same velocity and the neutral points attained with the RD process. Therefore the rolling process in accordance with the present invention has the following advantages:

(1) The rolling force of the existing rolling stands may be considerably reduced without major modifications.

(2) Since the rolling force can be reduced, the rolling reduction may be increased so that the rolling efficiency may be improved.

(3) Since the rolling force can be reduced, the wear of working rolls may be considerably reduced, the crown of the rolled metal piece may be minimized, and the dimensional tolerances may be remarkably improved.

(4) Since the neutral points are not fixed opposed to the RD process, the metal piece may be easily passed through the rolling mills, the rolling torques may be always transmitted and the stable rolling operation may be ensured.

What is claimed is:

1. A rolling process for a metal piece maintaining a peripheral velocity ratio between a pair of working rolls as high as possible but below a thickness ratio between the metal piece entering the working rolls and the same metal piece leaving the working rolls, whereby the rolling torque may be within a maximum tolerable torque.

* * * * *